US006266908B1

(12) United States Patent
Spencer et al.

(10) Patent No.: US 6,266,908 B1
(45) Date of Patent: Jul. 31, 2001

(54) FIREARM FRAME AND BARREL ASSEMBLY, METHOD OF ASSEMBLING AND ASSEMBLY TOOL

(75) Inventors: Norman Spencer, Longmeadow; William T. Oakley, Springfield; Craig Albert Mariani, Ludlow; Richard Frederick Mikuta, Easthampton; Kevin Richard Fleury, Feeding Hills; Brett Curry, Chicopee; Richard Anthony Picard, Ludlow; Joseph A. Galarneau, Agawam, all of MA (US); James Valley, Enfield, CT (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 09/173,826

(22) Filed: Oct. 16, 1998

(51) Int. Cl.[7] ..... F41C 23/10

(52) U.S. Cl. ..... 42/71.02; 42/75.02; 42/78; 42/90

(58) Field of Search ..... 42/71.02, 75.02, 42/78, 90

(56) References Cited

U.S. PATENT DOCUMENTS

| | | | | |
|---|---|---|---|---|
| 3,633,302 | * | 1/1972 | Lewis | 42/62 |
| 4,304,061 | * | 12/1981 | Brouthers | 42/59 |
| 4,580,484 | * | 4/1986 | Moore | 42/77 |
| 4,833,810 | * | 5/1989 | Domian | 42/59 |
| 4,841,836 | * | 6/1989 | Bundy | 89/14.1 |
| 5,305,678 | * | 4/1994 | Talbot et al. | 89/14.3 |

* cited by examiner

*Primary Examiner*—Stephen M. Johnson
(74) *Attorney, Agent, or Firm*—McCormick, Paulding & Huber LLP

(57) ABSTRACT

Revolver frame and barrel assembly including a frame, a barrel shroud carrying a sight and keyed in sight alignment with the frame, and a generally cylindrical barrel having a rifled bore and extending through the barrel shroud and threadably engaged in the frame retaining the shroud in assembly with the frame. An assembly tool engaged with and complementing the rifling grooves in the barrel applies predetermined torque to the barrel to assemble it with the frame.

8 Claims, 2 Drawing Sheets

FIREARM FRAME AND BARREL ASSEMBLY, METHOD OF ASSEMBLING AND ASSEMBLY TOOL

FIELD OF THE INVENTION

This invention relates to firearms.

BACKGROUND OF THE INVENTION

The present invention is primarily concerned with the production of a lightweight firearms, particularly revolvers, and deals more specifically with improvements in firearm frame and barrel assemblies of a type having a two-piece barrel which includes an inner barrel sleeve made of high-alloy steel and an outer barrel shroud made from a substantially lighter or less dense material, such as aluminum. Such two-piece barrel assemblies have been heretofore employed in the production of lightweight firearms. However, where gun design criteria requires that the outer shroud cover the inner barrel sleeve along substantially the entire length of the sleeve, the inaccessibility of the sleeve posses an assembly problem. In accordance with one successful solution to the assembly problem, the barrel pieces are assembled with a press fit and further secured in assembly by an anaerobic adhesive to form a unitary structure which is then assembled to a gun frame by the conventional process of engaging timed threads—a process which has been used in gun manufacture for about a century.

Since the barrel shroud usually includes a sight or at least provision for sight mounting, it is essential that the sight or its mounting means be properly aligned with the gun frame. In accordance with the aforesaid assembly method, torque must be applied to the gun barrel assembly to threadably secure it to the gun frame with proper sight alignment and is dependent upon thread timing, which makes it difficult to maintain uniform assembly torque. In some instances, frame and barrel parts must be individually fitted to obtain a desired result. Further, sight alignment relative to the frame must be externally gaged at assembly, all of which adds to the cost of producing a firearm.

Where a fully shrouded barrel is provided, it is conventional to apply assembly torque directly to the outer surfaces of the barrel shroud to secure the barrel assembly to the frame. This procedure can damage the surfaces to which torque is applied resulting in cosmetic defects and surface deformations. The present invention is concerned with the aforedescribed problems.

Accordingly, It is the general aim of the present invention to provide an improved lightweight barrel and frame assembly for a firearm which permits substantially uniform assembly torque to be specified and maintained in effecting assembly of a barrel subassembly with a gun frame during manufacture and which discourages a gun user from attempting disassembly of the barrel subassembly from the frame. It is a further aim of the invention to provide an improved barrel and frame assembly whereby sight-frame alignment is automatically attained during assembly, making it unnecessary to gauge sight alignment after assembly. Yet another aim of the invention is to provide an improved method and tool for assembling a lightweight two-piece barrel to the frame of a firearm without risk of damaging the external surfaces of the firearm during the assembly process.

SUMMARY OF THE INVENTION

In accordance with the present invention an improved firearm frame and barrel assembly is provided which includes a frame member, a barrel shroud member having a shroud bore and an abutment therein, and a generally cylindrical barrel sleeve having a rifled bore including spiral rifling grooves and extending into the barrel shroud bore and threadably engaged with the frame. An alignment means may be provided for retaining a sight position on the shroud member in a predetermined condition of alignment with the frame member during assembly of the shroud member with the frame member and when the shroud member is secured in assembly with the frame member by a bearing surface on the barrel sleeve in engagement with the abutment within the shroud bore. The barrel sleeve member has a muzzle portion disposed within and complementing a forward end portion of the shroud bore and terminated by a generally radially disposed and forwardly facing substantially smooth uninterrupted annular muzzle surface surrounding a muzzle end of said rifled bore. The portion of the barrel sleeve member which projects axially forwardly from the frame member is concealed along its entire axial length within the shroud member. An assembly tool having spiral lands which engage and complement the spiral rifling grooves in the rifled bore is employed to assemble the frame and barrel assembly in accordance with a method of the present invention.

DETAILED DESCRIPTION OF PREFERRED EMBODIMENTS AND METHOD

Figure 2:
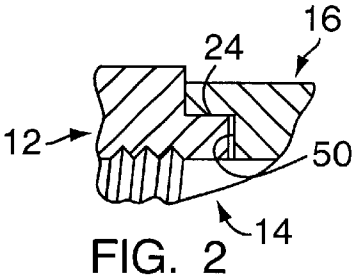
FIG. 2 is a somewhat enlarged fragmentary longitudinal sectional view of a portion of the assembly shown in FIG. 1.

In the drawings and in the description which follows the present invention is illustrated and described with reference to a revolver frame and barrel assembly, indicated generally by the reference numeral 10, for use is the production of a lightweight revolver (not shown). The illustrated assembly 10 essentially comprises a frame member, designated generally by the numeral 12, a barrel sleeve, best shown in FIGS. 3 and 4 and indicated generally at 14, and a barrel shroud member, indicated generally at 16.

The illustrated frame member 12 is adapted to support a side-swing cylinder (not shown) and has a generally rectangular cylinder receiving opening 18. An internally threaded barrel receiving bore 20 formed in the revolver frame forward of the barrel receiving opening 18 communicates with the barrel receiving bore and opens through a frontal surface of the frame, the latter surface of the frame being indicated at 22 and best shown in FIG. 3. The frame member 12 differs from a conventional revolver frame in that it has an integral key tab 24, for a purpose which will be hereinafter further discussed. The illustrated key tab 24 projects forwardly from the surface 22 immediately above the threaded opening 20, substantially as shown in FIG. 3.

Figure 4:
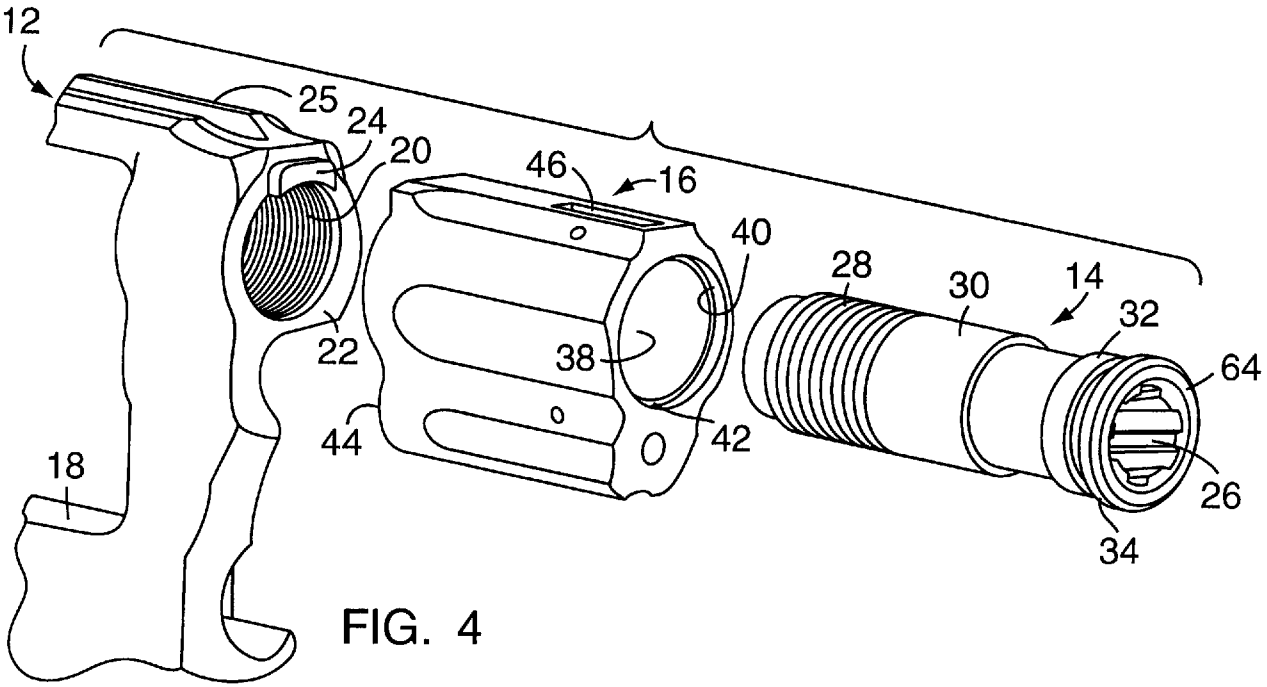
FIG. 4 is a somewhat enlarged exploded fragmentary perspective view of the frame member and barrel assembly shown in FIG. 1.
Figure 6:
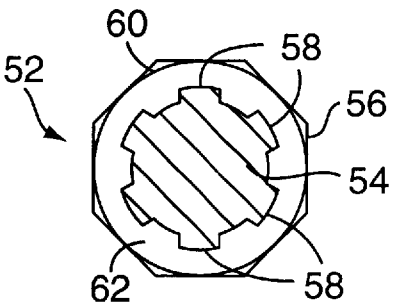
FIG. 6 is a somewhat enlarged sectional view taken along the line 6—6 a of FIG. 5.

An integral sighting rib 25 projects upwardly from and extends along the upper surface of the frame member, as best shown in FIG. 4.

Figure 3:
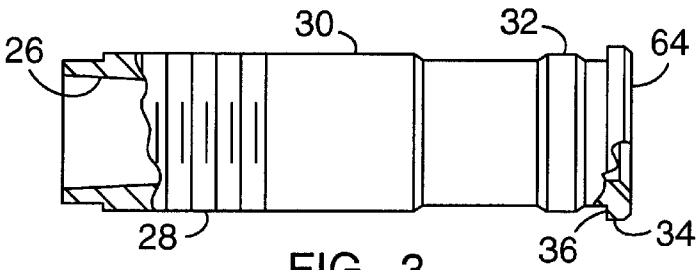
FIG. 3 is a somewhat enlarged fragmentary side elevational view of the barrel sleeve.

Considering now the barrel sleeve in further detail, and referring particularly to FIGS. 3 and 4, the illustrated barrel sleeve 14 comprises an axially elongated generally cylindrical sleeve formed from high-alloy steel and received within the barrel shroud member 16. The barrel sleeve has a generally cylindrical rifled bore 26 extending coaxially through it, the bore rifling being formed by conventional spiral rifling grooves cut in the wall of the bore 26, in a manner well known in the revolver art.

A rear portion of the barrel sleeve 14 is externally threaded, as indicated at 28, for mating engagement with the internal threads in the frame bore 20 in the revolver frame. The forward end portion of the barrel sleeve 14 is relieved to define a pair of axially spaced apart and radially outwardly facing coaxial cylindrical bearing surfaces of substantially equal diameter indicated at 30 and 32. A slightly diametrically enlarged annular flange 34 formed at the forward end of the barrel sleeve 14 defines an undercut and rearwardly facing radially disposed bearing surface 36, best shown in FIG. 3, and is terminated at the forwardmost end of the barrel sleeve by a generally radially disposed and forwardly facing substantially smooth uninterrupted annular muzzle surface 64 which coaxially surrounds a muzzle end of the rifled bore 26.

Figure 1:
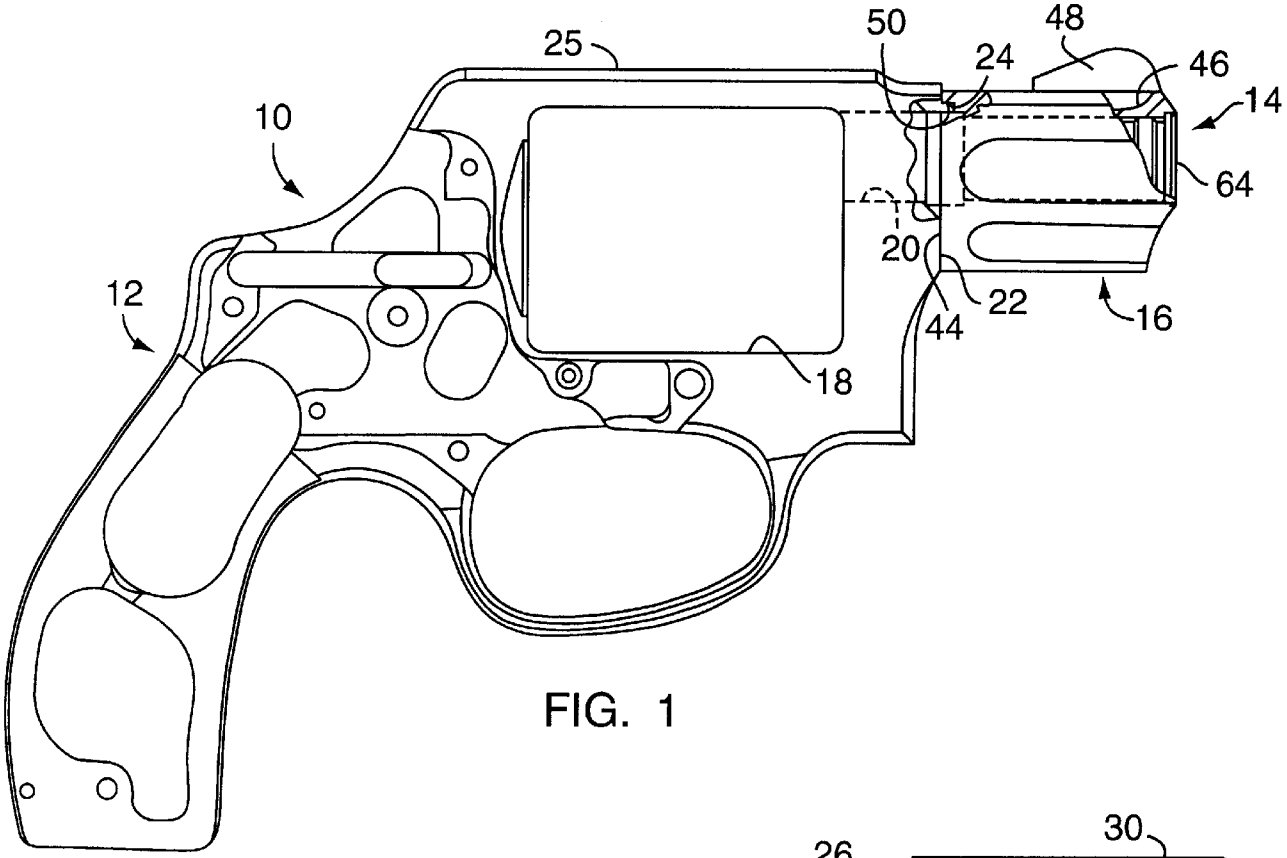
FIG. 1 is a side elevational view of a barrel and frame assembly shown with a portion of the barrel shroud member broken away to reveal the barrel sleeve therein.

The barrel shroud member 16 is made from a material having a density substantially less than the density of the material from which the barrel sleeve 14 is made for reduced revolver weight. In accordance with presently preferred practice the shroud member 16 is formed from aluminum and comprises an axially elongated member having a generally cylindrical smooth bore 38 extending axially through it. The bore 38 is sized to receive and substantially complement the bearing surfaces 30 and 32 and has a slightly diametrically enlarged outwardly open forward end portion, indicated at 40, for receiving and generally complementing the annular flange 34 on the barrel sleeve as shown in FIG. 1. The bore forward end portion 40 defines a generally radially disposed and forwardly facing seating surface 42 for engagement with the bearing surface 36 on the barrel sleeve. The barrel shroud member 16 further includes a radially disposed and rearwardly facing abutment surface 44 for complementary engagement with the forwardly facing seating surface 22 on the forward end of the revolver frame. The outer surface of the barrel shroud member 16 is preferably fluted, substantially as shown. The flutes formed in the surface of the shroud member impart a pleasing appearance to the revolver while enabling further revolver weight reduction. The upper surface of the barrel shroud member 16 is substantially flat and has an axially elongated upwardly open sight receiving groove 46 (FIG. 4) formed therein which comprises a sight positioning portion of the shroud member. The groove 46 is adapted to receive a forward sight 48 (FIG. 1) which is pinned or otherwise secured in fixed position to the shroud member. A key tab receiving slot 50 formed in the rear of the shroud member 16 immediately above the barrel receiving bore 40, as shown in FIGS. 1 and 2, complements the key tab 24 on the revolver frame 12. The key tab 24 and the associated key slot 50 within which the key tab is received are constructed and arranged to automatically align the front sight 48 and terminates at a chamfered edge with the rear sighting rib 25 on the revolver frame member when the barrel assembly, which includes the barrel sleeve 14 and the barrel shroud member 14, is assembled with the revolver frame member 12, as will be hereinafter described.

Figure 5:
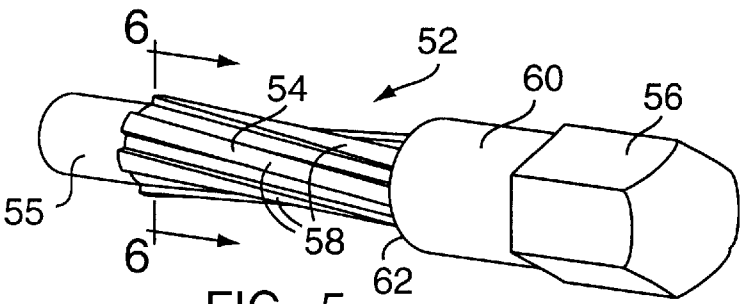
FIG. 5 is a perspective view of a firearm assembly tool embodying the invention.

In assembly, the barrel sleeve 14 is substantially wholly disposed along its entire length within and concealed by the barrel shroud member 16 so that only the muzzle surface 64 is visible and for this reason a special purpose barrel assembly tool, shown in FIG. 4 and indicated generally at 52, is employed to make the assembly. The illustrated tool 52 has a generally cylindrical axially elongated shank 54 and an integral diametrically enlarged head 56 of non-circular cross-section at one end. The presently preferred head 56 has an hexagonal cross-section substantially as shown. At its opposite or leading end of the shank 54 has a slightly conically tapered portion 55 which converges in a direction away from the head 56 in a predetermined condition of alignment. The shank 54 is sized to be received within and substantially complement the barrel sleeve bore 26, including the bore rifling, and has a plurality of spiral lands 58, 58 equal in number to the rifling grooves formed in the bore 26. The lands 58, 58 project radially outwardly from the shank and extend for some distance therealong, substantially as shown in FIG. 5.

The tool 52 is preferably made from a material somewhat softer than the material from which the barrel sleeve 14 is made, brass being the presently preferred material. A generally cylindrical sleeve 60 made from another material is received on the shank 54 adjacent the head 56, substantially as shown, and defines a generally radially disposed arresting surface 62 facing in the direction of the leading end of the tool shank. The sleeve 60 is made from a material softer than the material from which the tool shank 54 is made. In accordance with presently preferred construction, the sleeve 60 is formed from a non-metallic material, such as a plastic material.

In assembling the frame and barrel assembly 10 the barrel shroud member 16 is positioned with its rearwardly facing surface 44 in engagement with the forwardly facing surface 22 on the revolver frame 12 and with the key tab 24 on the frame disposed within the complementary key slot 50 in the barrel shroud member 16. Automatic sight alignment is thereby attained. The barrel sleeve 14 is slidably inserted into and through the sleeve bore 38 and rotated within and relative to the barrel shroud member to bring the external or male thread 28 on the barrel sleeve 14 into threadably engagement with the internal or female thread 20 on the revolver frame 12.

The leading end of the tool 52 is inserted into the muzzle end of the gun bore 26 and the lands 58, 58 are engaged within the associated rifling grooves in the gun bore 26. When the tool is fully inserted into the barrel the arresting surface 62 will engage with the muzzle surface on the annular flange 34 at the forward or muzzle end of the barrel sleeve. A torque wrench or other suitable driving tool (not shown) such as a pneumatic nut driver, for example, is employed to apply predetermined torque to the hexagonal head 56 on the tool 52, whereby assembly of the barrel assembly with the frame member is completed. Upon completion of the assembly operation, the tool 52 is removed from the gun bore 26.

What is claimed is:

1. A firearm frame and barrel assembly comprising; a frame member having a forwardly open internally threaded bore, an axially elongated generally cylindrical unitary barrel sleeve having a coaxial rifled bore therethrough including spiral rifling grooves and having an external thread on its rear end portion threadably engaged within said internally threaded bore, said barrel sleeve having an integral diametrically enlarged annular flange at its front end defining an uninterrupted radially disposed annular forwardly facing muzzle surface coaxially surrounding said rifled bore and a rearwardly facing annular bearing surface, a barrel shroud having a barrel receiving shroud bore extending axially therethrough and having a diametrically enlarged forwardly open recess at its forward end partially defined by a forwardly facing annular seating surface, said annular flange being wholly received within said recess with said bearing surface in engagement with said seating surface, and an assembly tool having an axially elongated shank received within said rifle bore and having radially outwardly projecting spiral lands extending therealong in complementary engagement within said spiral rifling grooves, said tool having arresting means for limiting the axial extent of said shank into said rifled bore, and means for applying torque to said assembly tool to threadably secure said barrel in assembly with said frame member whereby said barrel sleeve may be assembled with said frame member with an applied torque of predetermined magnitude.

2. A firearm frame and barrel assembly as set forth in claim 1 wherein said barrel shroud member has a sight position thereon and said assembly includes alignment means for retaining said sight position in a predetermined condition of alignment with said frame member during assembly of said shroud member with said frame member and when said shroud member is secured in assembly with said frame member by said barrel sleeve.

3. A firearm frame and barrel assembly comprising; a frame member having a forwardly open threaded barrel receiving bore, a barrel shroud member having a shroud bore extending therethrough, an axially elongated barrel sleeve member threadably engaged in assembly with said frame member within said barrel receiving bore and having an axially forwardly projecting portion extending from said frame member and into said shroud bore, said barrel sleeve member having a rifled bore extending in an axial direction therethrough and including rifling grooves, said barrel sleeve member having a muzzle portion disposed within and complementing a forward end portion of said shroud bore and terminated by a generally radially disposed and forwardly facing substantially smooth uninterrupted annular muzzle surface surrounding a muzzle end of said rifled bore, said axially forwardly projecting portion being disposed along its entire axial length within said barrel shroud member, retaining means concealed within said shroud bore for securing said barrel shroud member in assembly with said barrel sleeve member and said frame member when said barrel sleeve member is threadably engaged in assembly with said frame member and an assembly tool having an axially elongated tool shank received within and complementing an associated portion of said rifled bore and having radially outwardly projecting spiral lands extending for some axial distance therealong in complementary engagement with said rifling grooves within said rifled bore, arresting means for limiting axial extent of said tool shank into said rifled bore, and means for applying torque to said assembly tool to threadably connect said barrel sleeve member to said frame member, whereby said barrel sleeve member is connected to said frame member with an applied torque of predetermined magnitude.

4. A firearm frame and barrel assembly tool as set forth in claim 3 wherein said tool shank is made from a material softer than the material from which said barrel sleeve member is made.

5. A firearm frame and barrel assembly as set forth in claim 3 wherein said arresting means comprises a generally radially disposed arresting surface on said assembly tool for engaging said muzzle surface.

6. A firearm frame and barrel assembly as set forth claim 5 wherein said arresting means is defined by a tubular sleeve received on said tool shank.

7. A firearm frame and barrel assembly as set forth in claim 6 wherein said sleeve is made from a material softer than the material from which said tool shank is made.

8. A firearm frame and barrel as set forth in claim 6 wherein said tool shank has a conically tapered leading end.

* * * * *